US006705711B1

(12) United States Patent
Richards

(10) Patent No.: US 6,705,711 B1
(45) Date of Patent: Mar. 16, 2004

(54) METHODS, SYSTEMS, AND DEVICES FOR CONTROLLING INK DELIVERY TO ONE OR MORE PRINT HEADS

(75) Inventor: David B. Richards, Fremont, CA (US)

(73) Assignee: Oće Display Graphics Systems, Inc., San Jose, CA (US)

( * ) Notice: Subject to any disclaimer, the term of this patent is extended or adjusted under 35 U.S.C. 154(b) by 0 days.

(21) Appl. No.: 10/164,442

(22) Filed: Jun. 6, 2002

(51) Int. Cl.[7] ..... B41J 2/175
(52) U.S. Cl. ..... 347/85; 347/87
(58) Field of Search ..... 347/84, 85, 86, 347/87, 17

(56) References Cited

U.S. PATENT DOCUMENTS

| | | | | |
|---|---|---|---|---|
| 3,790,703 | A | | 2/1974 | Carley |
| 3,929,071 | A | | 12/1975 | Cialone et al. |
| 4,079,384 | A | | 3/1978 | Takano et al. |
| 4,084,165 | A | | 4/1978 | Perry et al. |
| 4,089,007 | A | | 5/1978 | Perry et al. |
| 4,270,133 | A | | 5/1981 | Shimazawa et al. |
| 4,346,388 | A | | 8/1982 | Wiley |
| 4,394,663 | A | | 7/1983 | Ameyama |
| 4,719,472 | A | | 1/1988 | Arakawa |
| 5,606,349 | A | | 2/1997 | Droit et al. |
| 5,646,666 | A | * | 7/1997 | Cowger et al. ..... 347/87 |
| 5,782,184 | A | | 7/1998 | Albertalli et al. |
| 5,880,748 | A | | 3/1999 | Childers et al. |
| 5,988,802 | A | | 11/1999 | Pawlowski, Jr. et al. |
| 5,992,986 | A | | 11/1999 | Gyotoku et al. |
| 5,997,124 | A | | 12/1999 | Capps et al. |
| 6,168,252 | B1 | | 1/2001 | Yaji |
| 6,302,516 | B1 | | 10/2001 | Brooks et al. |
| 6,305,786 | B1 | | 10/2001 | Plotkin et al. |
| 6,318,833 | B1 | | 11/2001 | Lyman et al. |
| 6,318,851 | B1 | | 11/2001 | Hoen et al. |
| 6,328,399 | B1 | | 12/2001 | Wen |
| 6,331,052 | B1 | | 12/2001 | Murai et al. |

* cited by examiner

*Primary Examiner*—Juanita Stephens
(74) *Attorney, Agent, or Firm*—Workman Nydegger

(57) ABSTRACT

A printing system includes a printing device fluidly communicating with a main ink reservoir and a vacuum pump. The main ink reservoir refills one or more reservoirs mounted within the printing device when the ink contained therein falls below a defined tolerance level. The vacuum pump varies a level of a vacuum or partial vacuum within the reservoir to maintain a pressure level at one or more nozzles of one or more print heads mounted in the printing device. Variations in the level of the vacuum or partial vacuum can be based upon the desired pressure at the nozzles, the particular volume or level of ink stored within the reservoir, and the type of ink stored within the reservoir. Through creating the vacuum or partial vacuum, the inks stored within the reservoir are degassed before being delivered to the print head.

63 Claims, 8 Drawing Sheets

METHODS, SYSTEMS, AND DEVICES FOR CONTROLLING INK DELIVERY TO ONE OR MORE PRINT HEADS

BACKGROUND OF THE INVENTION

1. The Field of the Invention

The present invention relates generally to controlling the delivery of ink to one or more print heads and, more specifically, generally relates to controlling the pressure of ink delivered to one or more print heads from an ink reservoir.

2. The Relevant Technology

Printing devices, such as ink-jet printing devices, are well known and available from various manufacturers. A typical ink-jet printing device includes multiple print heads mounted on a movable carriage. Each print head contains one or more ink-jet nozzles through which ink is delivered during a printing process. For instance, as the movable carriage is repeatedly scanned back and forth across a printable medium, such as a paper sheet, the ink-jet nozzles in the various print heads are activated to lay or deliver drops of ink on the printable medium at precise locations. In typical color printing, between four and six different colors of ink are deposited over an area by multiple heads, in successive scans across the sheet.

Following a print pass, relative movement between the printing device and the medium is provided. This relative movement enables a different portion of the medium to be printed during each subsequent scan. As those skilled in the art will appreciate, the nozzles on each of the multiple print heads must be controlled to deposit ink drops in precise locations relative to drops deposited by the other print heads. The control of the ink delivered from the nozzles has a profound effect upon the quality of images created by ink jet printers.

To maintain high quality while depositing ink at fast rates, it is important that all deposited ink drops have substantially the same volume so that all printed drops are consistent in size. When the volume of deposited ink is either excessive or insufficient, differences in the printed image are perceptible. These differences in the printed image quality may occur when a meniscus of the ink at one or more nozzles extends beyond the boundaries of the specific nozzle to encroach upon one or more of the surrounding nozzles. The encroaching of the ink results in excessive ink deposited upon printable media during a print process, thereby reducing the image quality. Further, the excessive ink can solidify over one or more of the nozzles and prevent ink from being deposited upon printable media during a printing process. Again, this reduces the image quality of the printed image.

Additionally, differences in printed image quality can occur when the meniscus of ink at a nozzle becomes concave and extends inwardly through the nozzle and into the print head. When this occurs, insufficient ink is deposited from the print head, resulting in decreased image quality. Furthermore, when a curvature of the meniscus exceeds specific limits governed by the surface tension characteristics of the ink and the adhesion of the ink to the nozzle, the meniscus can break. When the meniscus breaks, ink "drools" from the nozzle before, after and during a printing process. This again results in reduced image quality of the printed image.

Many attempts have been made to control the volume of ink deposited from the print nozzles. Further, many attempts have been made to control the curvature of the meniscus of the ink at the nozzles to prevent insufficient or excessive amounts of ink from being deposited upon printable media during a printing process.

In numerous ink-jet printers, ink is delivered to each print head by a tube that connects the print head to an ink reservoir positioned above the vertical level of the print head. During the printing process, ink flows along the tube to the nozzle of the print head under the force of gravity as the weight of the ink within the ink reservoir forces the ink stored in the tubing toward the nozzles. The volume of ink forced to each nozzle depends upon the particular volume of ink stored in the ink reservoir, fluid dynamic characteristics of the tubing, and chemical characteristics or properties of the ink. For instance, when an ink having a high absolute viscosity is employed with a printing device, a low volume of ink is forced to a nozzle under a given pressure. Similarly, when an ink having a low absolute viscosity is employed with a printing device a high volume of ink is forced to a nozzle under the same given pressure. Changes to the chemical composition of the ink causes changes in the effectiveness of these gravity-type ink-jet printers. Therefore, these ink-jet printers are difficult to use with a variety of different inks.

Other ink jet printers utilize a surge suppressor to pressurize the ink as it is passed into the ink reservoir. The surge suppressor maintains an average pressure within the tube connecting the ink reservoir with the print head. Typically, the surge suppressor used in such ink-jet printers is designed for a particular ink, with associated characteristics and properties. Additionally, surge suppressors are typically not adjustable and allow large ranges of pressure fluctuations.

Consequently, it would be an advance in the art to provide systems and methods that maintain high quality image reproduction through control of the volume of ink deposited from a nozzle of a print head. Further, it would be an advance in the art to provide systems and methods that control the curvature of the meniscus, while preventing insufficient or excessive deposit of ink during a printing process.

BRIEF SUMMARY OF THE INVENTION

In accordance with the invention as embodied and broadly described herein, a printing system capable of delivering ink to printable media is disclosed. One particular printing system includes a printing device that communicates with a vacuum pump and a remote main ink reservoir. During a printing process, the remote main ink reservoir delivers ink to the printing device to maintain the ink stored in an ink reservoir of the printing device within selected tolerances. Meanwhile, the vacuum pump creates a vacuum or partial vacuum within the ink reservoir to maintain a pressure of the ink within selected tolerances so that the ink is delivered from a print head during the printing process. Through operation of the vacuum pump, the pressure exerted by the ink at one or more nozzles of the print head is maintained with desired tolerances no matter the particular volume of ink stored within the ink reservoir. Consequently, the potential for excessive or insufficient delivery of ink from the print head is reduced or eliminated.

According to one aspect of one embodiment of the present invention, a provided printing device includes a housing with a printer head carriage mounted to and slidable upon a track. The printer head carriage supports one or more ink reservoirs that communicate with a vacuum pump and a remote main ink reservoir. Disposed within one or more of the ink reservoirs are sensors to identify a level of ink and a vacuum or partial vacuum level within the one or more ink reservoir. These sensors send signals indicative of the sensed levels to a controller that is adapted to control the operation of the vacuum pump and an ink pump associated with the remote main ink reservoir to maintain the level of ink and the vacuum or partial vacuum level within desired tolerances.

According to another aspect of one embodiment of the present invention, a printing device communicates with an accumulator, which is disposed between the printing device and the vacuum pump. The accumulator functions to increase the resolution, the accuracy, and the precision of the vacuum pump. In this manner, the printing system can accurately control the vacuum or partial vacuum level within the ink reservoir and hence maintain the pressure of the ink at the one or more nozzles of the one or more print heads.

According to another aspect of one embodiment of the present invention, a printing system includes a vacuum pump that communicates with an ink reservoir of the printing device. The vacuum pump can degas the ink stored within or communicating with the ink reservoir to allow gas dissolved within the ink to migrate to and escape from a surface of the ink. This can be achieved, in one configuration, by creating a vacuum or partial vacuum within the ink reservoir.

According to another aspect of one embodiment of the present invention, a printing system is adapted to accommodate the use of multiple types of ink. The printing system includes a vacuum pump that is used to control the level of a vacuum or partial vacuum within an ink reservoir. A controller changes a level of vacuum or partial vacuum based upon the level of ink within the ink reservoir to achieve a desired pressure at one or more nozzles of one or more print heads. The inks used within the printing system can each have different chemical compositions and hence different flow characteristics that govern the manner in which the ink flows from the ink reservoir, along one or more tubes, to the one or more print heads. When ink reservoirs with a second type of ink are substituted for ink reservoirs with a first type of ink, the controller can vary the level of vacuum or partial vacuum to accommodate for changes in ink characteristics between the first and second types of ink, such as but not limited to, changes in adhesions, surface tension, viscosity, or other characteristics of the inks.

According to another aspect of one embodiment of the present invention, by creating a vacuum or partial vacuum within an ink reservoir, a printing system can control the size, shape, and configuration of a meniscus of the ink formed at one or more nozzles of one or more print heads. In addition to the degree of attraction of the ink to the material forming the nozzles and the surface tension characteristics of the ink, the curvature of the meniscus is affected by the pressure exerted by the column of ink extending from the nozzle to the exposed surface of the ink within the ink reservoir. Through varying the level of the vacuum or partial vacuum within the ink reservoir, embodiments of the printing system can change the curvature of the meniscus to control the volume of ink to be delivered from the nozzles and limit the meniscus from rupturing or extending onto the outer surface of the print head.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
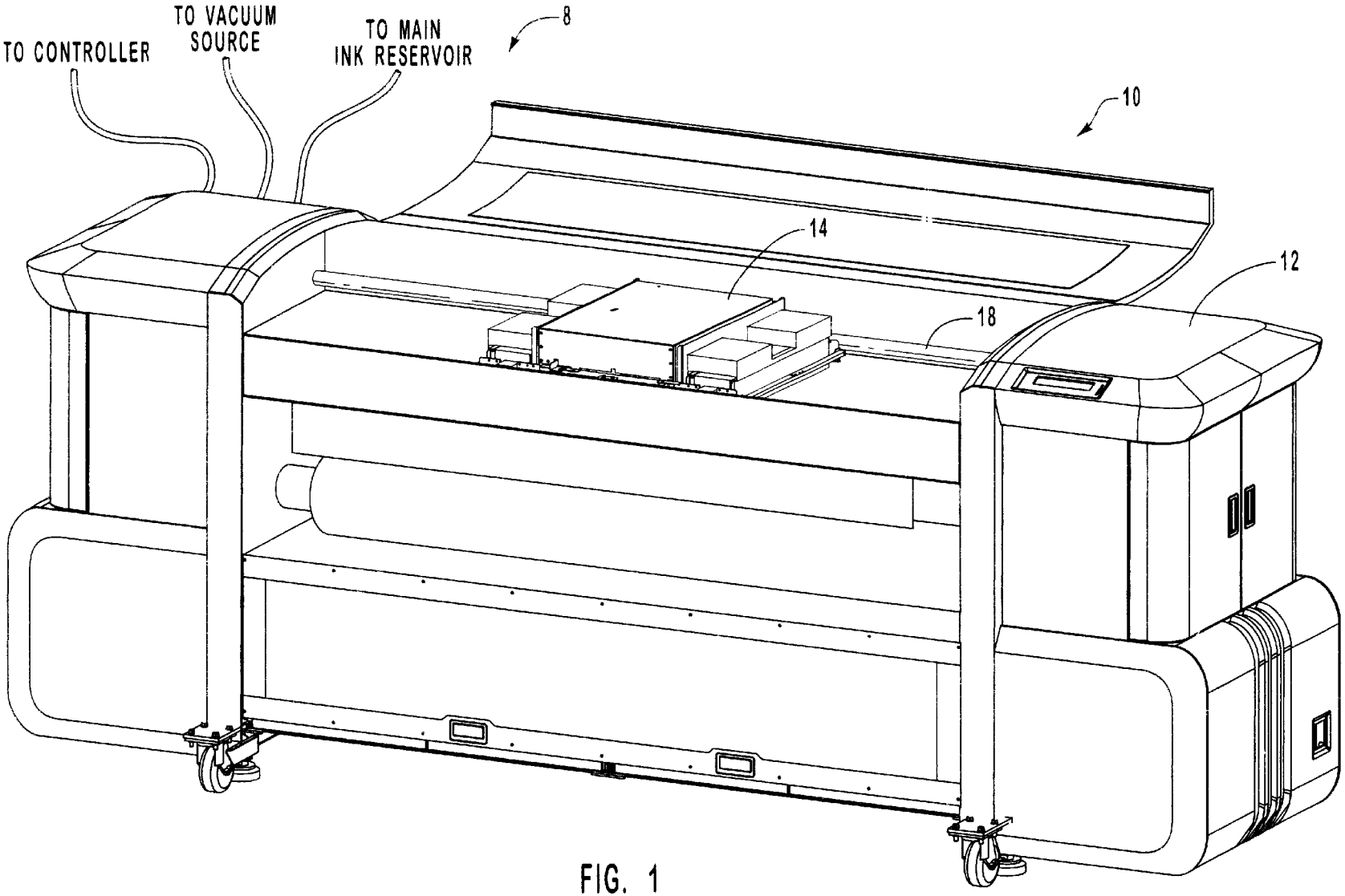
FIG. 1 illustrates a perspective view of an exemplary printer device of a printing system in accordance with one embodiment of the present invention.

The present invention relates to systems, methods and apparatus for delivering ink to one or more print heads. Embodiments of illustrative systems, methods and apparatus of the present invention facilitate ink delivery to one or more nozzles of one or more print heads, while the pressure exerted by the ink at one or more nozzles is maintained within defined tolerances. By maintaining the pressure of the ink within defined tolerances, embodiments of the present invention provide a mechanism for correctly delivering a volume of ink to thereby limit the potential for depositing excessive or insufficient quantities of ink upon printable media. Therefore, through providing mechanisms for controlling the delivery or deposit of ink from one or more print heads, embodiments of the present invention can improve the quality of the perceived color and clarity of print images.

According to another aspect of one embodiment of the present invention, a vacuum or partial vacuum is created within an ink reservoir that stores the ink to be delivered from a print head. The vacuum or partial vacuum aids with controlling a pressure exerted by the ink at one or more nozzles of the print head. The level of the vacuum or partial vacuum within the ink reservoir can be changed to control the pressure of the ink at the one or more nozzles of the print head. By so doing, embodiments of the present invention provide a mechanism to control the volume of ink delivered through the one or more nozzles of the print head and maintain the operability of the print head.

Through providing control of the vacuum or partial vacuum level within the reservoir, an embodiment of the present invention provides systems, methods, and apparatus that can accommodate a variety of inks having differing characteristics and properties without the need for significant expense and time associated with testing of the particular system or device for each particular ink. Further, control of the vacuum or partial vacuum level provides a mechanism to control the size, shape, and configuration of a meniscus of the ink formed at one or more nozzles of one or more print heads. Changes to the curvature of the meniscus can control the volume of ink discharged from the nozzles of the print head during a printing process.

As used herein, the terms "vacuum" and "partial vacuum" refer to a pressure that is lower than ambient pressure or atmospheric pressure for a particular geographic location of the print system or device of the present invention. The terms "vacuum" and "partial vacuum" are used interchangeably to refer to pressures below or deviation from ambient pressure or atmospheric pressure.

Another embodiment of the systems, methods, and apparatus provide mechanisms for degassing inks used within the printing systems or devices. By so doing, the systems, methods, and apparatus reduce the requirement for expensive and complicated degassing equipment, as is typically the case with existing printing systems.

The following discussion of illustrative systems, methods, and apparatus of the present invention will be directed to large format printing systems and devices. One skilled in the art, however, can appreciate that the teachings of the present invention can be utilized in various other types of printing systems or devices, ranging from small home use printers or systems to other large commercial printers or systems. Further, although reference is made to the use of ink, it can be understood that structures and functions of the present invention can be used in any situation where a pressure of a fluid is controlled by varying a level of a vacuum or partial vacuum within a container storing the particular fluid. The fluid with the container can be in a liquid or gaseous state.

Referring now to FIG. 1, depicted is an exemplary configuration of one printing system of the present invention. The printing system 8 includes a printing device 10 and a main ink reservoir, a controller, and a vacuum source (not shown). The printing system 8 is capable of delivering ink to a printable media. The inks can include, but not limited to, an air-dry pigmented liquid, a heat dry pigmented liquid, an ultraviolet curable pigmented liquid, absorbable liquid, or other type of ink capable of being delivered by one or more print heads. In another configuration, printing system 8 is capable of delivering other fluids through associated print heads, such as but not limited to fluids for etching glass, metallic fluids to be deposited on a media, or any other fluid that may be deposited from a nozzle and receive a benefit from the teaching of the present invention.

Printing device 10 includes a housing 12 that retains various components and control mechanisms of printing device 10, only some of which will be described herein for ease of explanation of the present invention, while others will be understood by those skilled in the art in light of the teaching contained herein.

Figure 2:
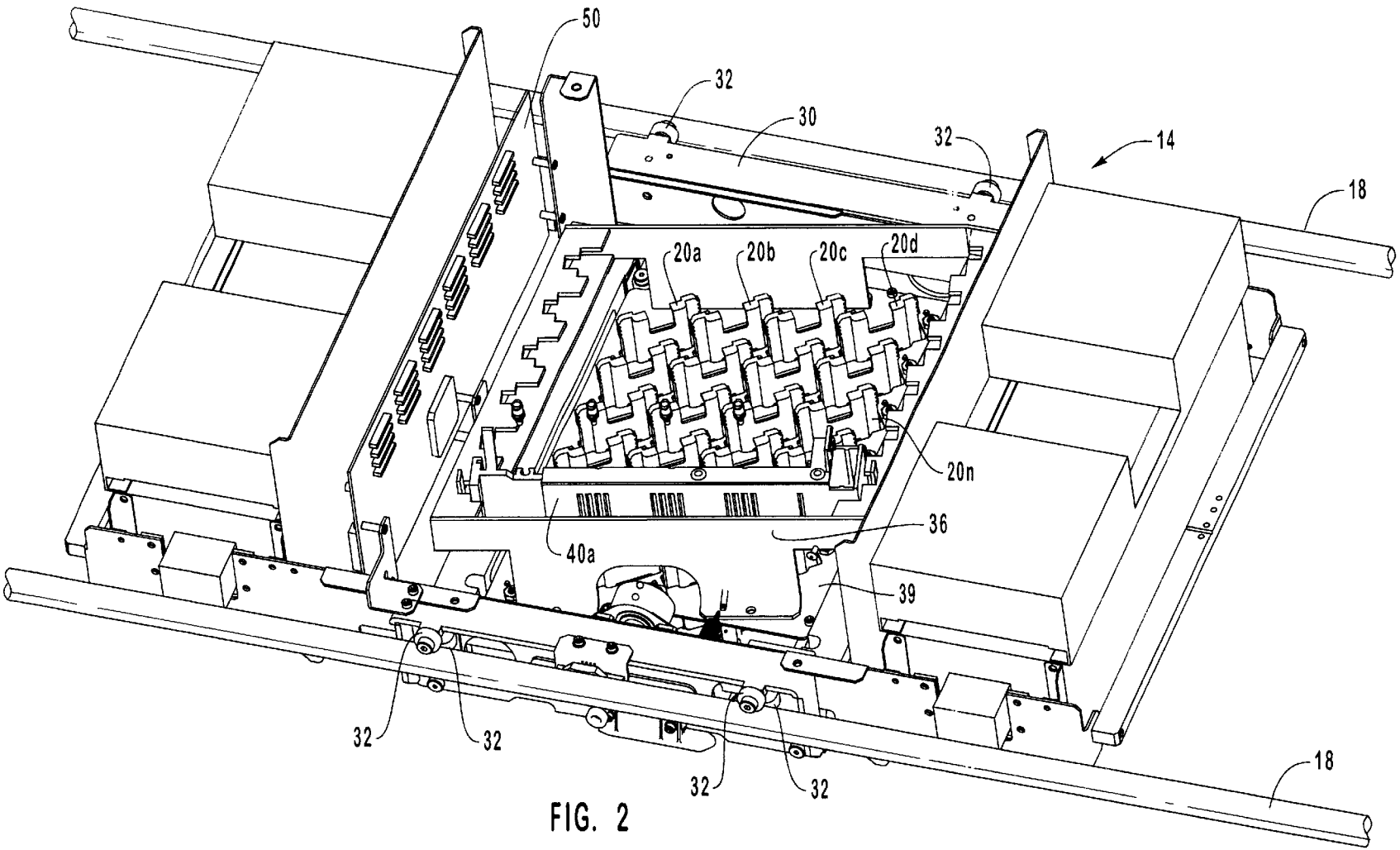
FIG. 2 illustrates a perspective view of an exemplary printer head carriage and track of the printer device of FIG. 1 in accordance with one embodiment of the present invention.

Disposed within housing 12 is a printer head carriage 14 that is movably mounted to a track 18 of printing device 10. The printer head carriage 14 moves back and forth along track 18 and allows delivery of ink from one or more print heads 20*a*–20*n* mounted to printer head carriage 14, as illustrated in FIG. 2. Relative movement of printer head carriage 14 along track 18 can occur through various driving mechanisms. For instance, the driving mechanism can include, but not limited to, hydraulic or pneumatic driver mechanisms, mechanical driver mechanisms, chain or belt and driven sprocket mechanisms, combinations thereof, or other types of driving mechanism that are capable of performing the function of moving the printer head carriage along a track.

With reference to FIG. 2, depicted is a partially assembled printer head carriage 14. A support structure 30 forms part of printer head carriage 14. This support structure 30 slidably cooperates with track 18 and includes one or more wheels 32 to allow printer head carriage 14 to be moved along track 18 under the influence of the driving mechanism. Although reference is made to the use of wheels, it can be understood that printer head carriage 14 can includes various other mechanisms that are capable of performing the function of aiding to move printer head carriage 14 along track 18. The above are exemplary structures capable of performing the function of means for moving one or more printer heads during a printing process. Further, the discussed structures are capable of performing the function of means for moving a printer head carriage along a track.

Figure 3:
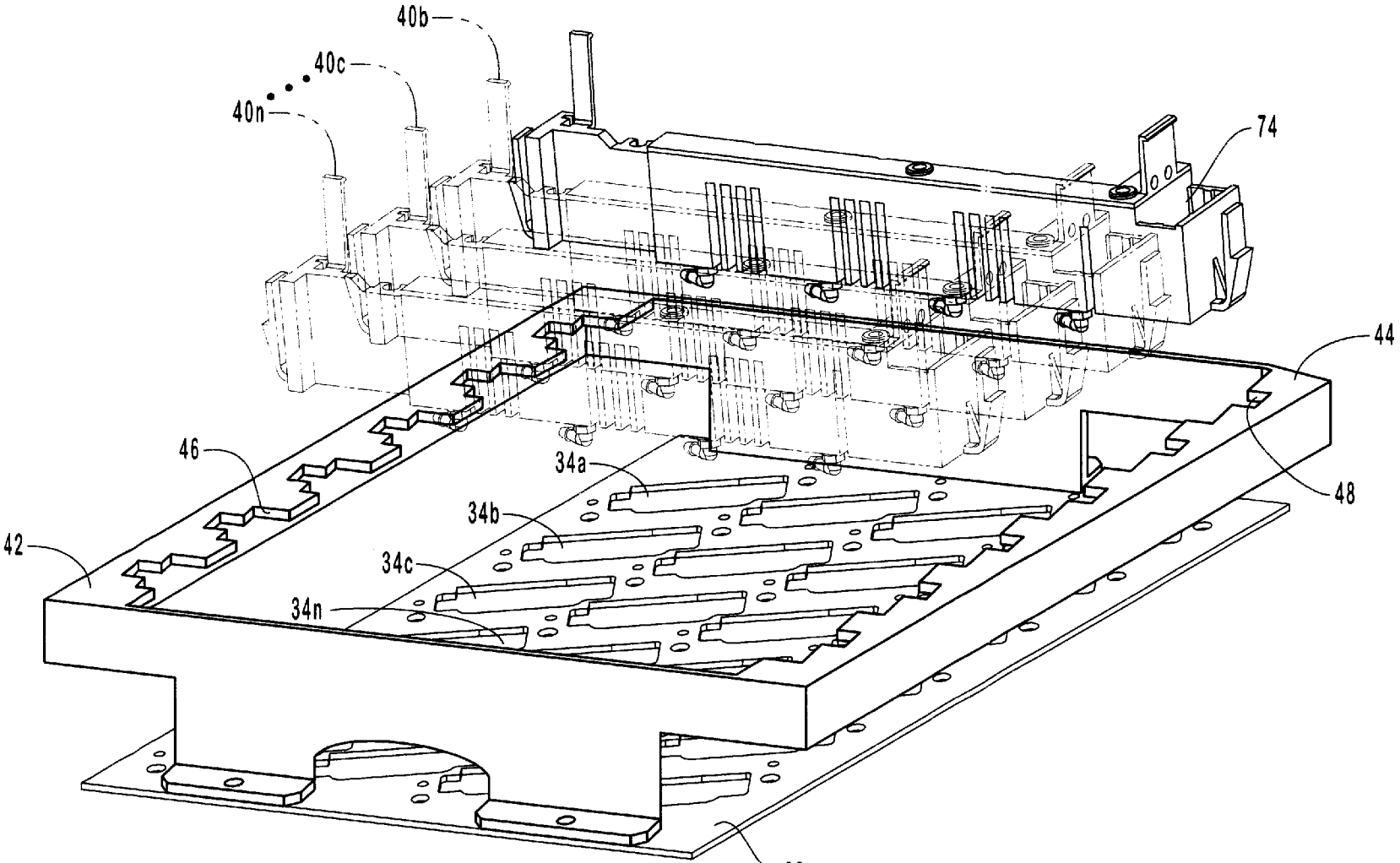
FIG. 3 illustrates an exploded perspective view of a printer head carriage of the printer device of FIG. 1 in accordance with one embodiment of the present invention.

In addition to cooperating with track 18, support structure 30 securely retains a print head support 38 that securely retains print heads 20*a*–20*n* in releasable engagement therewith. With reference to FIG. 3, print head support 38 includes a plurality of apertures 34*a*–34*n*, each of which is configured to maintain a print head 20*a*–20*n* (FIG. 2) in an upright or substantially vertical orientation. By maintaining print heads 20*a*–20*n* (FIG. 2) in the desired orientation, the ink can be accurately deposited or delivered upon printable media, such as but not limited to, a cellulose media, a plastic media, a metallic media, a synthetic media, silk media, canvas media, paper media, textile material, a media formed form one or more naturally occurring substances, a media formed from one or more synthetic substances, combinations thereof, or other media that is capable of receiving ink delivered from the print heads during a printing process. Apertures 34*a*—34*a* of print head support 38 cooperate with print heads 20*a*–20*n* (FIG. 2) to allow releasable engagement between the same. Therefore, print heads 20*a*–20*n* (FIG. 2) and apertures 34*a*–34*n* can have various complementary configurations that are capable of performing the function of releasably engaging one with another. Stated another way, print head support 38, whether alone or in combination with print heads 20*a*–20*n* (FIG. 2), includes structures that are capable of performing the function of means for engaging one or more print heads with a support. Illustratively, and not by way of limitation, such structures can include slip-fit or snap fit mechanism to releasably or permanently attaching each print head 20*a*–20*n* (FIG. 2) within a respective aperture 34*a*–34*n*. Alternatively, each print head 20*a*–20*n* is maintained in within respective apertures 34*a*–34*n* through one or more fasteners, such as any fastener that is capable of performing the function of or act as a means for engaging a print head to a support.

Returning to FIG. 2, mounted to support structure 30 is a reservoir support 36. The reservoir support 36, as seen in FIGS. 2 and 3, receives one or more reservoirs 40*a*–40*n* that store ink to be delivered from print heads 20*a*–20*n* to printable media (not shown). For instance, reservoir support 36 can receive an ink reservoir with one type of ink and subsequently receive another ink reservoir with another similar or dissimilar ink.

Each side 42 and 44 of reservoir support 36 includes one or more recesses 46 and 48 respectively. A recess 46 cooperates with one end of a single reservoir 40*a*, for instance, while recess 48 cooperates with the opposite end of reservoir 40*a*. The particular configuration of recesses 46 and 48 is such that reservoirs 40*a*–40*n* disposed therein are maintained a distance from print heads 20*a*–20*n* when the same are disposed within apertures 34*a*–34*n*. Further, the configuration of each recess 46 and 48 aids with securely retaining the respective reservoir 40*a*–40*n* disposed therein.

Reservoir support 36 is one structure capable of performing the function of means for supporting one or more reservoirs. The reservoir support 36 or means for supporting can have various configurations. For instance, and not by way of limitation, each recess 46 and 48 can cooperate with structures or fasteners formed on each reservoir 40*a*–40*n* to cause releasable and/or permanent engagement between reservoir 40*a*–40*n* and reservoir support 36. Alternatively, each reservoir 40*a*–40*n* can cooperate with structures or fasteners associated with each recess 46 and/or 48 to cause releasable and/or permanent engagement between reservoir 40*a*–40*n* and reservoir support 36.

Figure 4:
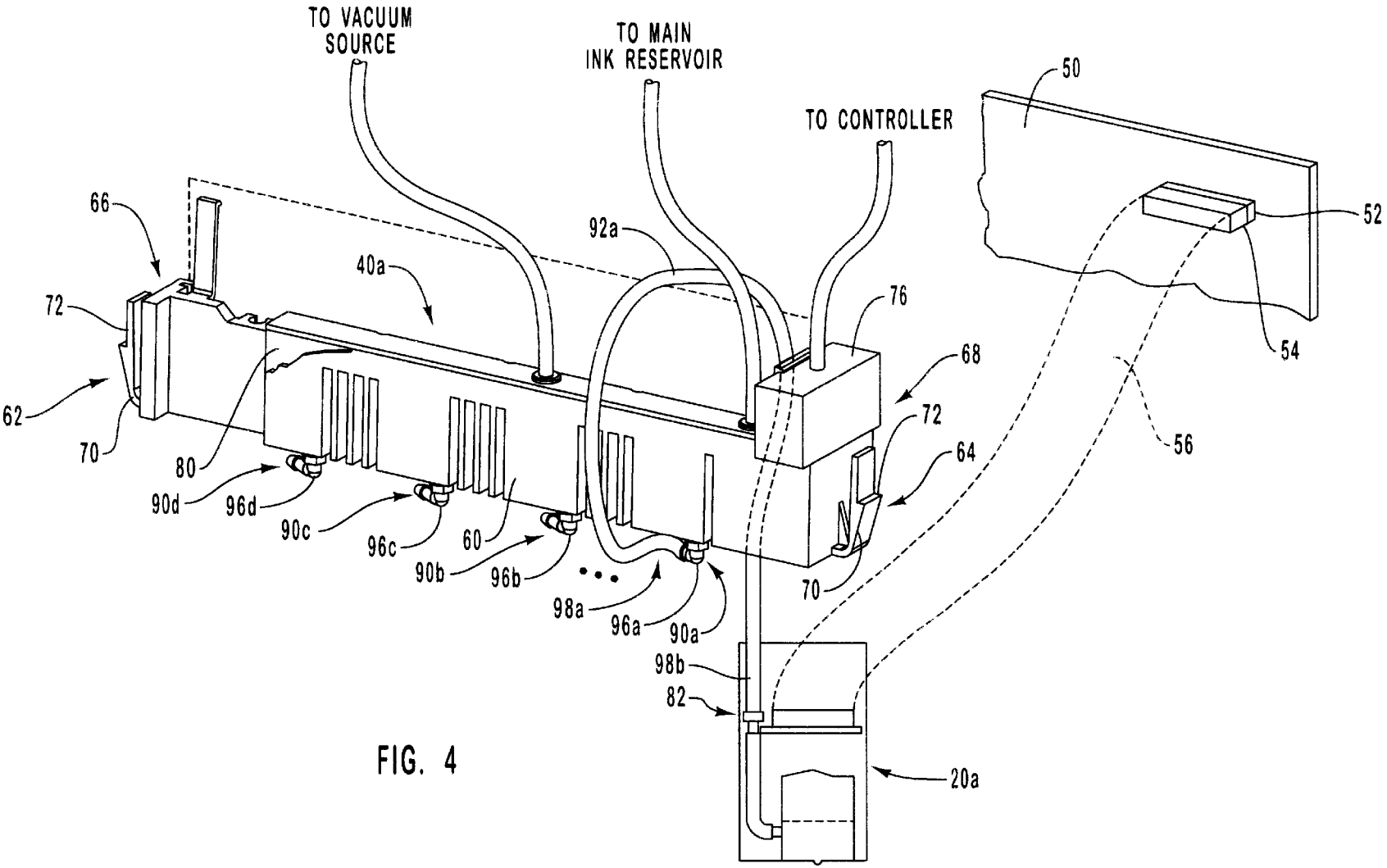
FIG. 4 illustrates a perspective view of an exemplary reservoir, print head, control board and associated communicating tubes and ribbons forming part of the printer head carriage of FIG. 1 in accordance with one embodiment of the present invention.

Mounted to support structure 30 is control board 50. The control board 50 provides an interface between print heads 20*a*–20*n* and the control systems and circuitry (not show) of printing device 10 (FIG. 1) and/or printing system 8 of the present invention. In one configuration, as shown in FIG. 4, control board 50 includes a connector 52 that mates with the corresponding connector 54 on ribbon wire 56. This ribbon wire 56 extends from control board 50 to an individual print head, such as print head 20*a* and allows signals to be transmitted from control board 50 to initiate the delivery of ink from each print head 20*a*–20*n*. The control board and ribbon wire are illustrative of one structure capable of performing the function of means for delivering control signals to a print head. Once skilled in the art can identify a variety of other configuration. For instance, in another configuration, a plurality of electrical conductors extends from control board 50 to print heads 20*a*–20*n*. In still another configuration, wireless or infrared technology is used to deliver signals to print heads 20*a*–20*n*.

With continued reference to FIG. 4, depicted is an illustrative configuration of the various components and control connections associated with one ink reservoir and one print head. Although the following discussion relates to a single reservoir and one print head and those components communicating or connected thereto, a similar discussion may be made for multiple reservoirs and multiple associated components.

As illustrated, reservoir 40*a* includes a housing 60 with an interior space 80. The interior space 80 of reservoir 40*a* is adapted to store a quantity or volume of ink that can be delivered to one or more print heads 20*a*–20*n*. In one configuration, reservoir 40*a* stores about 2 milliliters to about 1000 milliliters of ink. In another configuration, reservoir 40*a* stores about 2 milliliters to about 100 milliliters of ink, while in another configuration reservoir 40*a* stores about 2 milliliters to about 3 milliliters of ink. Consequently, reservoir 40*a* can have a width of about 0.125 inches to about 4 inches. In an alternate configuration, reservoir 40*a* can have a width of about 0.125 inches to about 1 inch. In still another configuration, reservoir 40*a* can have a width of about 0.125 inches to about 0.250 inches.

The housing 60 of reservoir 40*a* includes engagement mechanisms 62 and 64 disposed at ends 66 and 68 respectively. In this particular configuration, each engagement mechanism 62 and 64 includes a leg 70 extending from respective end 66 or 68. Each leg 70 is biased to extend from respective end 66 or 68, while is capable of being temporarily moved toward end 66 or 68 as reservoir 40*a* engages or disengages with reservoir support 36. A step portion 72 formed in leg 70 cooperates with recess 46 or 48 (FIG. 3) of reservoir support 36 to prevent inadvertent removal of reservoir 40*a* from reservoir support 36. When leg 70 is moved toward end 66 or 68, step portion 72 disengages from reservoir support 36 and releases reservoir 40*a* therefrom. Each engagement mechanism 62 and 64, therefore, cooperates with a respective recess 46 and 48 (FIG. 3) of reservoir support 36 to securely retain reservoir 40*a* in the desired position relative to print heads 20*a*–20*n*.

The engagement mechanism described above is one structure capable of performing the function of means for coupling a reservoir to a support. One skilled in the art can identify a variety of other configurations of engagement mechanism and hence means for coupling. For instance, in other configurations, engagement mechanisms can be configured to cause snap-fit engagement, slip-fit engagement, friction-fit engagement, releasable fastener engagement, where a fastener is capable of performing the function of releasably attaching a reservoir to a support, or some other engagement mechanism capable of acting as means for coupling a reservoir to a support. In still other configurations, engagement mechanisms can cause permanent engagement through, but not limited to, adhesives, thermal bonds, chemical bonds, welds, or other fastener, methods, techniques, or structures capable of permanently attaching one or more reservoirs to a support. When permanent engagement occurs between one or more reservoirs and a support, replacing used reservoirs occurs through replacing the reservoirs and support with another support with either permanently or releasably attached reservoirs.

In another configuration, reservoir 40*a* includes one or more engagement mechanisms. In still another configuration, reservoir support 36 (FIG. 3) can include one or more engagement mechanisms, while reservoir 40*a* cooperates with reservoir support 36. In another configuration, each end 66 and 68 of reservoir 40*a* can be configured with a respective recess, while recesses 46 and 48 can include complementary engagement mechanism(s). In still another configuration, ends 66 and 68 cooperate with reservoir support 36 (FIG. 3) through fasteners or other structures formed in the reservoir and/or reservoir support that are capable of performing the function of attaching the reservoir to the reservoir support.

Referring again to FIG. 3, disposed at end 68 of reservoir 40*a* is a port 74, which receives a sensor device 76 (FIG. 4). As shown in FIG. 4, sensor device 76 can be releasably mounted in port 74 so that sensor device 76 can be removed from port 74 when reservoir 40*a* is replaced within another reservoir having similar or dissimilar ink therein.

Figure 5:
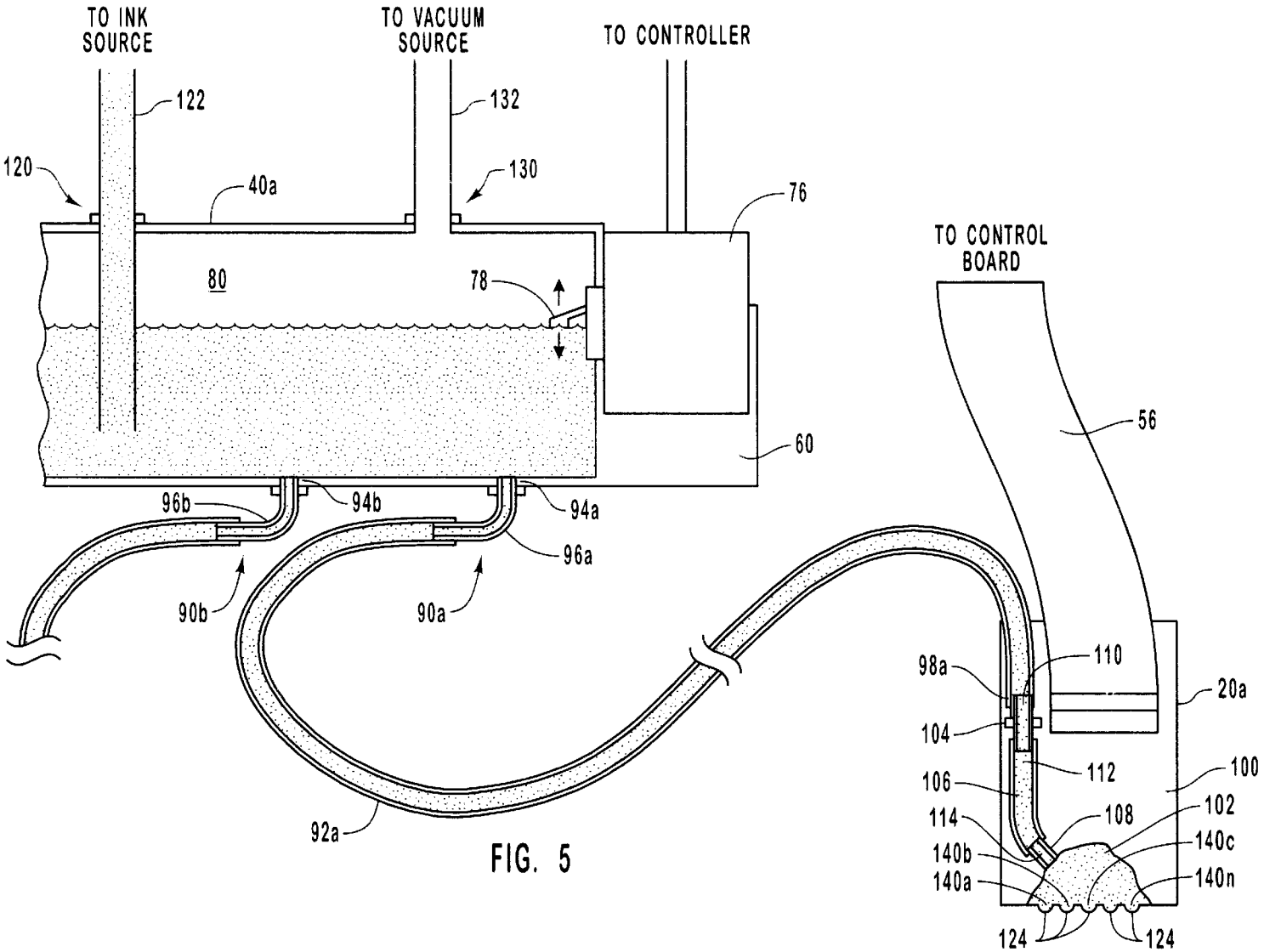
FIG. 5 illustrates partial cross-sectional side view of the exemplary reservoir, print head, control board and associated communicating tubes and ribbons forming part of the printer head carriage of FIG. 1 in accordance with one embodiment of the present invention.

Port 74 cooperates with sensor device 76 such that sensor device 76 cooperates with a sensor 78 located within an interior space 80 of reservoir 40*a*, as illustrated in FIG. 5. As depicted, sensor 78 may have the configuration of a float-type fluid level sensor, however, various other types of sensor can be used within embodiments of the present invention. For instance, in another configuration, an optical sensor can be used to detect the level of the ink within reservoir 40*a*. In another configuration, one or more thermistors are used to identify the temperature within reservoir 40*a* the temperature within reservoir 40*a* being related to the quantity of ink within interior space 80 of reservoir 40*a*. Using the detected temperature, the volume of ink within reservoir 40*a* can be identified. In another configuration, a sensor is used to detect the mass of ink within reservoir 40*a* the mass of ink being used to define the volume of ink within reservoir 40. Generally, any type of sensor that is capable of identifying a level of a fluid contained within a container, such as but not limited to a reservoir, can be used to act as sensor device 76 and/or sensor 78.

Sensor device 76 cooperates with sensor 78 to receive signals indicating the ink level of the ink within interior space 80 of reservoir 40*a*. Upon receiving the signals, sensor 78 delivers those signals to the controller via a wire, cable, optical fiber, wireless transmitters and receivers, or other structure or devices capable of performing the function of delivering signals indicative of an ink level to the controller. In another configuration, sensor device 76 is eliminated and sensor 78 communicates directly with the controller.

The sensor is an example of a structure capable of performing the function of means for identifying a level of fluid within a reservoir. Further, the sensor in combination with the sensor device is another example of a structure capable of performing the function of means for identifying a level of fluid within a reservoir. Additionally, the sensor device alone is another example of a structure capable of performing the function of means for identifying a level of fluid within a reservoir. In addition to the above, one skilled in the art can identify various other structures that are capable of performing this desired function.

Referring to both FIGS. 4 and 5, the illustrative housing 60 of reservoir 40*a* includes four ink outlets 90*a*–90*d*. These outlets 90*a*–90*d* are adapted to facilitate delivery of ink from reservoir 40*a* to print head 20*a*. More specifically, outlets 90*a*–90*d* provide a fluid path between reservoir 40*a* and one or more tubes 92*a*–92*n* communicating with print heads 20*a*–20*n*, only print head 20*a* being depicted in FIGS. 4 and 5. Although reference is made to four outlets 90*a*–90*n*, one skilled in the art can appreciate that housing 60 can include one or more outlets.

In this particular configuration, and illustrated in FIG. 5, each outlet 90*a*–90*d* includes an aperture 94*a*–94*n* within housing 60, only apertures 94*a* and 94*b* are depicted. Disposed within each aperture 94*a*–94*n* is a connector 96*a*–96*n*, only connectors 96*a* and 96*b* are depicted in FIG. 5. Each connector 96*a*–96*d* includes threads that engage with complementary threads formed in respective apertures 94*a*–94*d* of housing 60 to create a fluid path between reservoir 40*a* and tubes 92*a*–92*d* attached to respective connectors 92*a*–92*d*. In an alternate configuration, each connector 96*a*–96*d* slip-fits or snap-fits within respective apertures 94*a*–94*n* formed in housing 60 of reservoir 40*a*. In still another configuration, each connector 96*a*–96*d* can be integrally formed with housing 60 of reservoir 40*a*.

As illustrated in FIGS. 4 and 5, tubes 92*a*–92*d* connect to outlets 90*a*–90*n*. By connecting outlets 90*a*–90*n* to tube 92*a*–92*n*, tubes 92*a*–92*n* provide a fluid pathway for the ink with interior space 80 of housing 60 and respective print heads 20*a*–20*n*. In this exemplary configuration, a proximal end 98*a* of each tube 92*a*–92*d* connects to one of outlets 90*a*–90*d*, while a distal end 98*b* of each tube 92*a*–92*d* connects to a print heads 20*a*–20*n*. Alternatively, a proximal end 98*a* of each tube 92*a*–92*d* can connect to one or more outlets 90*a*–90*d*, while distal end 98*b* of each tube 92*a*–92*d* can connect to one or more print heads 20*a*–20*n*. The tubes 92*a*–92*d* are examples of structures capable of performing the function, whether alone or in combination with one or more of the structures described herein, of means for providing a fluid pathway between a reservoir and a print head. Other structures are known to those skilled in the art in light of the teaching contained herein.

Turning to FIG. 5, each tube 92*a*–92*d* can have an inside diameter from about ¼ inch to about 1/32 inch. In another configuration, each tube 92*a*–92*d* has an inside diameter of about 3/32 inch. As with the number of ink outlets formed in reservoir 40*a*, one or more tubes can be used with different configurations of the present invention.

Disposed at a distal end 98*b* of tube 92*a* is a print head 20*a*. Similarly, but not shown, disposed at the distal ends of the tubes are the print heads. An exemplary print head 20*a* includes a body 100 that has an interior chamber 102 and one or more nozzles 140*a*–140*n* disposed in body 100 that communicate with interior chamber 102. In this exemplary configuration, ink passes from tube 92*a*, for example, to interior chamber 102 via lumens 110, 112, 114 associated respectively with a connector 104, an intermediate tube 106, and a port connector 108 of print head 20*a*. These lumens 110, 112, 114 create a fluid pathway for the ink to traverse from reservoir 40*a* to interior chamber 102, before the ink is delivered from nozzles 140*a*–140*n*.

Although reference is made to specific lumens 110, 112, and 114 associated with connector 104, intermediate tube 106, and port connector 108 of print head 20*a*, one skilled in the art can appreciate that various other configurations of the present invention are possible, so long as ink can traverse a fluid pathway from reservoir 40*a* to print head 20*a*. More generally, the above-described lumens of the print head are structures capable of performing the function, whether alone or in combination with one or more of the structures described herein, of means for providing a fluid pathway between a reservoir and a print head. An alternate configuration, and hence alternate means for providing a fluid pathway, utilizes a single lumen extending from reservoir 40*a* to print head 20*a* to form the desired fluid pathway. In still another configuration, multiple lumens form the fluid pathway from reservoir 40*a* to print head 20*a*.

In addition to the above, lumens 110, 112, and 114 associated with connector 104, intermediate tube 106, and port connector 108 of print head 20*a* are examples of structure capable of performing the function of means for delivering a volume of a fluid to printable media during a printing process. Furthermore, the connectors permanently or releasably attached to the reservoir, the one or more print heads, and the tubes connecting the print heads to the reservoir are exemplary structures capable of performing the function of means for delivering a volume of a fluid to printable media during a printing process. In still another configuration, the control board and ribbon connector are includes as exemplary structures capable of performing the function of means for delivering a volume of a fluid to printable media during a printing process. Other structure capable of assisting with or forming part of the means for delivering a volume of a fluid to printable media during a printing process are known to one skilled in the art in light of the teaching contained herein.

With continued reference to FIG. 5, generally, body 100 of print head 20*a* is adapted to securely retain circuitry and associated piezo-electric components used to deliver ink during a printing process. Although reference is made to print head 20*a* using piezo-electric components and technology to deliver ink during a printing process, one skilled in the art can identify various other components and technologies that are capable of delivering ink from the print heads, such as but not limited to, components associated with thermal printing technologies, electrical printing technologies, solid ink technologies, or other printing technologies known to those skilled in the art.

In addition to outlets 90*a*–90*d*, reservoir 40*a* includes an ink inlet 120. The ink inlet 120 communicates with a remote main ink reservoir 210 (FIG. 7) by a tube 122. The remote main ink reservoir 210 contains a volume of ink that can be added to reservoir 40*a* as ink is delivered to print head 20*a* during a printing process. In this manner, ink extends continuously and completely between portions of reservoir 40*a*, outlet 90*a*, tube 92*a*, and along the fluid pathway defined by lumens 110, 112, and 114 to interior chamber 102 and nozzles 140*a*–140*n*.

Figure 6:
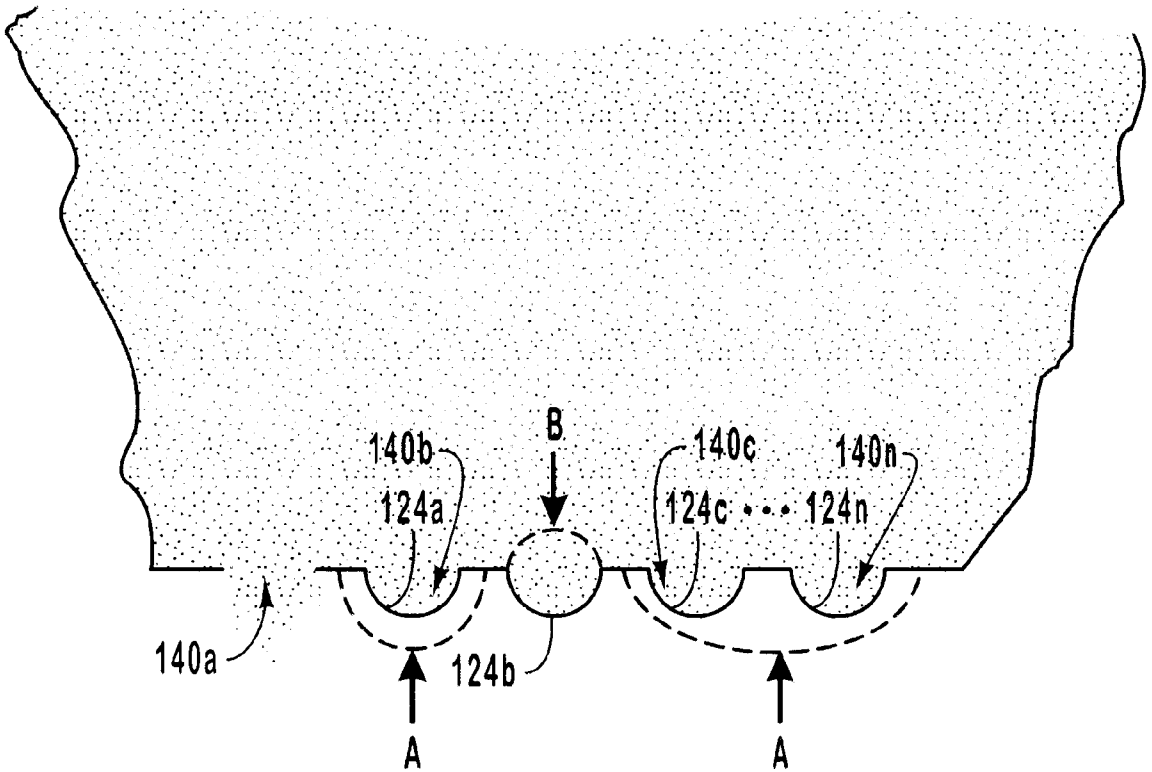
FIG. 6 illustrates a cross-sectional side view of an exemplary print head, including one or more nozzles, of the printer device of FIG. 1 in accordance with one embodiment of the present invention.

At nozzles 140*a*–140*n*, the ink from reservoir 40*a* forms a meniscus 124 or interface between the ink and nozzles 140*a*–140*n*, as shown in FIGS. 5 and 6. The curvature of meniscus 124 is controlled by the degree of attraction of the ink to the material forming nozzles 140*a*–140*n* and the surface tension characteristics of the ink. Additionally, the curvature of meniscus 124 is affected by the pressure exerted by the ink above the vertical level of nozzles 140*a*–140*n* because the pressure exerted by the ink at nozzles 140*a*–140*n* is based upon the difference in vertical height between nozzles 140*a*–140*n* and the vertical level of the ink within reservoir 40*a*. In the event that the attraction of the ink to the material forming nozzles 140*a*–140*n* is exceeded, the surface tension characteristics changed, or the pressure exceeds a certain level, the curvature of meniscus 124 will be changed so that meniscus 124 has a convex configuration and extends beyond the limits of nozzles 140*a*–140*n*, as depicted by dotted lines A. The extended meniscus 124 can cause print head 20*a* to deliver a volume of ink greater than is needed during a printing process, resulting in excessive deposit of ink, incorrect mixing of inks, and poor image quality. In some instances, the extended meniscus will encroach upon adjacent nozzles, thereby preventing the effective delivery of ink from one or more nozzles 140*a*–140*n*.

In the event that the pressure is lower than a certain level, there is a potential for ambient pressure to be sufficient to force meniscus 124 to have a concave configuration, as depicted by dotted line B. Further, if the pressure is lower than a certain level, there is a potential for the ambient pressure to be sufficient to overcome the attraction or surface tension characteristics of the ink, resulting in meniscus 124 rupturing, as depicted with nozzle 140*a* that is devoid of a meniscus. In such a case, the ink can flow freely through nozzle 140*a* and "drool" from the print head. The retracted or broken meniscus can cause print head 20*a* to deliver, respectively, either an insufficient volume of ink or a greater than needed volume of ink during a printing process. In both cases, incorrect mixing of inks and poor image quality occurs.

Maintaining the desired ink pressure is achieved by maintaining the volume of ink within selected tolerances, such tolerances being based upon the particular ink and its associated characteristics and/or properties. By maintaining the level of ink within reservoir 40*a* within the proscribed tolerances, the pressure of the ink is maintained within desired tolerances and the correct volume of ink is delivered from the print heads during a printing process. Additionally, the pressure is sufficient to prevent rupturing of meniscus 124 and/or extending meniscus 124 beyond desired limits.

The deviation from ambient pressure or atmospheric pressure of the pressure exerted by the ink at nozzles 140*a*–140*n* can be from about −5 inches of water to about 20 inches of water, when measured at about 60° F. In another configuration, the deviation from ambient pressure or atmospheric pressure of the pressure exerted by the ink at nozzles 140*a*–140*n* can be from about 3 inches of water to about 10 inches of water. In still another configuration, the deviation from ambient pressure or atmospheric pressure of the pressure exerted by the ink at nozzles 140*a*–140*n* can be from about 6 inches of water to about 8 inches of water. In another configuration, pressure exerted by the ink at nozzles 140*a*–140*n* can be substantially equal to ambient pressure or atmospheric pressure.

Stated another way, the deviation from ambient pressure or atmospheric pressure of the pressure exerted by the ink can ranges from about −9.34 torr to about 37.37 torr. In another configuration, the deviation from ambient pressure or atmospheric pressure of the pressure exerted by the ink at nozzles 140*a*–140*n* can be from about 5.60 torr to about 18.68 torr. In still another configuration, the deviation from ambient pressure or atmospheric pressure of the pressure exerted by the ink at nozzles 140*a*–140*n* can be from about 11.21 torr to about 14.95 torr. In another configuration, the pressure exerted at nozzles 140*a*–140*n* is substantially equal to ambient pressure or atmospheric pressure.

Stated another way, the deviation from ambient pressure or atmospheric pressure of the pressure exerted by the ink can range from about −0.18 PSI to about 0.72 PSI. In another configuration, the deviation from ambient pressure or atmospheric pressure of the pressure exerted by the ink at nozzles 140*a*–140*n* can be from about 0.11 PSI to about 0.36 PSI. In still another configuration, the deviation from ambient pressure or atmospheric pressure of the pressure exerted by the ink at nozzles 140*a*–140*n* can be from about 0.22 PSI to about 0.29 PSI. In another configuration, the pressure exerted at nozzles 140*a*–140*n* is substantially equal to ambient pressure or atmospheric pressure.

Figure 7:
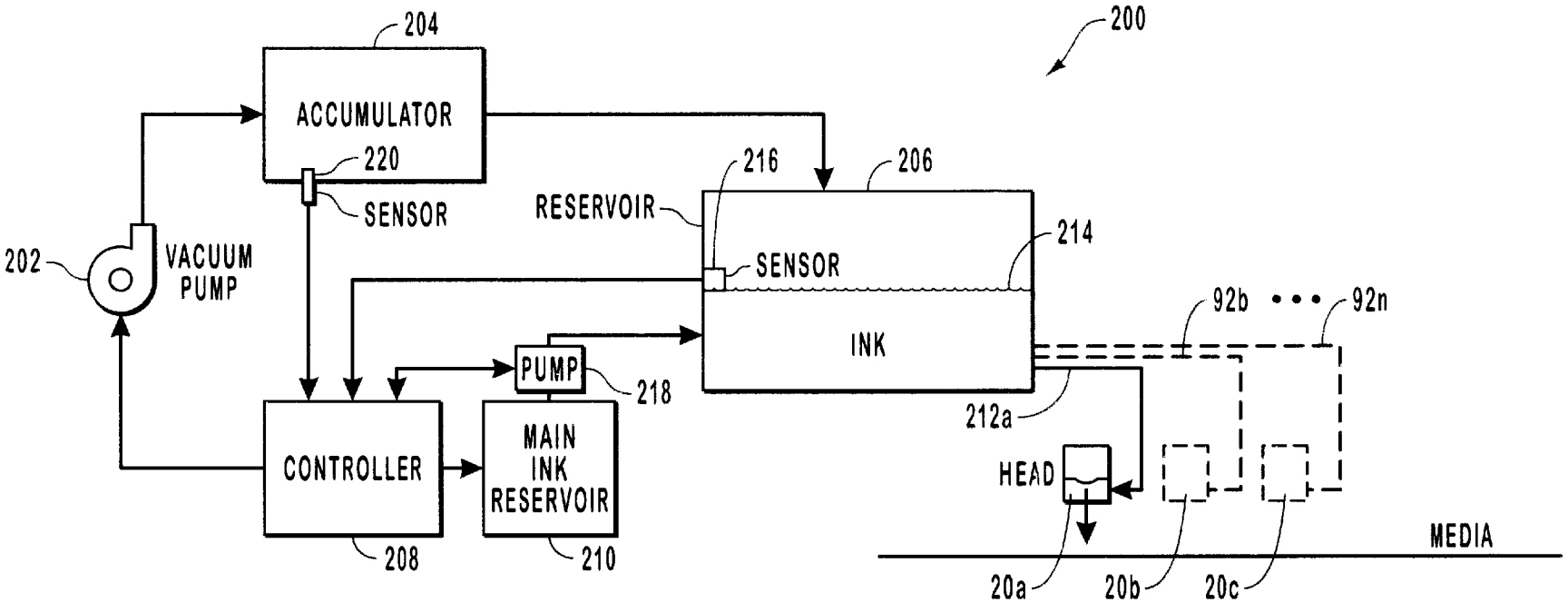
FIG. 7 illustrates a schematic representation of an exemplary printing system of one embodiment of the present invention.

To aid in maintaining the desired pressure, housing 60 of reservoir 40*a* includes an inlet 130, shown in FIG. 5, which communicates with a vacuum source (not shown) via a tube 132. The vacuum source is schematically illustrated in FIG. 7. The vacuum source, such as but not limited to a vacuum pump, a vacuum pump in combination with an accumulator, a vacuum pump with air bleed, combinations, thereof, or other device capable of producing a vacuum or partial vacuum within reservoir 40*a*. This vacuum can be varied based upon the particular volume of ink within the reservoir, the properties and characteristics of the ink, the temperature of the ink, desired curvature of the meniscus of the ink at one or more of the nozzles of one or more print heads, to thereby maintain the pressure of the ink within the desired tolerances.

By creating a vacuum or partial vacuum within the reservoir, the column of ink extending from the reservoir to the nozzles of the print heads are "drawn" upwardly away from the nozzles, thereby changing the pressure exerted by the ink at the nozzles of the print heads. This "drawing" effect also allows printing system 8 to control the volume of ink disposed at the print heads and the curvature of the meniscus at each nozzle. Further, changing the level of the vacuum or partial vacuum allows printing system 8 to accommodate a variety of different inks. This is achieved by mitigating the fluid dynamic and chemical properties of the ink and materials forming the reservoir, the tubes, and the print heads through changing the level of the vacuum or partial vacuum to thereby maintain the pressure at the nozzles within a desired level where each meniscus neither ruptures nor extends outwardly from respective nozzles.

Additional components and systems of printing system 10 of one embodiments of the present invention are schematically depicted in FIG. 7. The following description will be directed to a single reservoir and one or more print heads. One skilled in the art can understand that a similar discussion can be made for multiple reservoirs and associated multiple print heads.

As shown, printing system 200 includes reservoir 206 that is in fluid communication with print head 20*a,* in a similar manner as described above. Reservoir 206 can have a similar configuration to reservoir 40*a* described above.

The reservoir 206 fluidly communicates with a remote main ink reservoir 210 through appropriate tubes or other structures capable of functioning to deliver ink from one reservoir to another reservoir. The main ink reservoir 210 can be any type of container that is capable of storing ink. Consequently, main ink reservoir 210 is one example of structure capable of performing the function of means for remotely storing a fluid.

Main ink reservoir 210 includes an outlet that provides the ink to reservoir 206 as ink is delivered to print heads 20*a*–20*n* before, during, or subsequent to a pass of printer head carriage 14 (FIGS. 1 and 2) of the print media during the printing process. As the printing process progresses, i.e., ink is delivered from one or more of print heads 20*a*–20*n* to printable media, the level of ink within reservoir 206 may come close to falling outside of defined tolerance levels. One tolerance level defines a maximum volume of ink to be maintained within reservoir 206, while another tolerance level defines a minimum volume of ink to be maintained within reservoir 206. These tolerance levels can have values that are either the same or different one from another. For instance, in one configuration, if we define a level 214 as a median of a tolerance range, the actual ink level can be maintained within a range of about +/−1 inch. In another configuration, the actual ink level can be maintained within a range of about +/−½ inch. In still another configuration, the actual ink level can be maintained within a range of about +/−⅛ inch from level 214. Stated another way, the actual ink level of the ink remains within +/−2.54 centimeters from level 214. In another configuration, the actual ink level can be maintained within a range of about +/−1.27 centimeters from level 214. In still another configuration, the actual ink level can be maintained within a range of about +/−0.32 centimeters from level 214. These tolerances can be maintained during the printing process and/or refilling of reservoir 206.

To maintain the ink level within the above-identified tolerances, ink is delivered to reservoir 40*a* from main ink reservoir 210 under the command of controller 208, such as one or more mechanical devices, hydraulic devices, pneumatic devices, electrical devices, optical devices, or combinations of such devices. Ink delivery occurs when a sensor 216 with in reservoir 206 delivers a signal to controller 208 that indicates the level of ink within reservoir 206. The controller 208 can analyze the signal and determine whether that the ink level is outside of tolerance or becoming close to being outside tolerance. Based upon this determination, controller 208 can activate a pump 218, disposed either within main ink reservoir 210 or external to main ink reservoir 201, to force ink into reservoir 206.

In another configuration, sensor 216 can deliver a signal indicating that the level of the ink is becoming close to or currently exceeds a defined tolerance. In response to receiving such a signal, controller 208 can activate pump 218 to force or deliver ink to reservoir 206 to place the level of ink within tolerances.

Therefore, controller 208, whether alone or in combination with one or more of the structures defined herein, such as but not limited to one or more sensors, sensor devices, control boards, ink reservoirs, and/or ink pumps, is one structure capable of performing the function of means for varying a level of a fluid within a reservoir or container. One skilled in the art can identify a variety of other structures that are capable of performing this desired function.

In addition to receiving signal indicating the level of ink within reservoir 206, controller 208 can communicate with a sensor 220 that is disposed in either accumulator 204 or reservoir 206 to sense the particular a level of the vacuum or partial vacuum therein. The sensor 220 can be a pressure sensor, a precision pressure sensor, or some other sensor capable of detecting the level of vacuum or partial vacuum within reservoir 206 and/or accumulator 204. This sensor 220 is one structure capable of performing the function of means for identifying a level of a vacuum or partial vacuum. One skilled in the art can identify various other configurations of the sensor that are capable of performing the desired function.

Whether sensor 220 identifies a level of a vacuum or partial vacuum within accumulator 204 and/or reservoir 206, controller 208 can utilize the sensed level of the vacuum or partial vacuum either alone or in combination with the sensed level of the ink to identify changes to be made to the level of the vacuum or partial vacuum and corresponding signals to be sent to vacuum pump 202 and/or ink pump 218. Alternatively, controller 208 can utilize the sensed level of the ink alone to identify changes to be made to the level of the vacuum or partial vacuum and thereafter generate signals to be sent to vacuum pump 202 and/or ink pump 218 to change the level of the vacuum or partial vacuum within reservoir 206. Therefore, controller 208, whether alone or in combination with one or more of the structures defined herein, such as but not limited to one or more sensors, sensor devices, control boards, vacuum pumps, and/or accumulators, is one structure capable of performing the function of means for varying the level of the vacuum or partial vacuum within a reservoir.

The vacuum pump 202 is configured to move air from within reservoir 206 and accumulator 204 under the command of controller 208. The vacuum pump 202 can remove air from reservoir 206*a* and/or accumulator 204 or alternatively move air from within reservoir 206 to accumulator 204. In the latter case, vacuum pump 202 can create changes in the level of the vacuum or partial vacuum within reservoir 206 by causing air molecules to compress together or allowing air molecules to separate one from another.

Communicating with vacuum pump 202 is accumulator 204. The accumulator 204 aids with creating and changing the level of the vacuum or partial vacuum within reservoir 206. The accumulator 204 is disposed between vacuum pump 202 and reservoir 206 and functions to increase the resolution, the accuracy, and the precision of vacuum pump 202. By providing a large volume of air or other fluid within accumulator 204, the pumping effects of vacuum pump 202 are translated into small, incremental changes in the level of the vacuum or partial vacuum within reservoir 206. Consequently, the combination of vacuum pump 202 and accumulator 204 can maintain the level of the vacuum or partial vacuum within reservoir 206 to achieve the desired pressure of the ink at the nozzles (not shown) of print head 20*a*.

The vacuum pump, either alone or in combination with the accumulator, are exemplary structures capable of performing the function of means for creating a vacuum or partial vacuum within a reservoir. One skilled in the art can identify various other structures that are capable of performing this desired function. Further, the accumulator is one structure capable of performing the function of means for increasing the precision of a vacuum pump. One skilled in the art can identify various other structures that are capable of performing this desired function. For instance, in another configuration, a vacuum pump with a regulated air bleed can function as the vacuum pump.

Illustratively, the deviation from ambient pressure or atmospheric pressure causing the vacuum or partial vacuum in reservoir 206 by vacuum pump 202 and/or accumulator 204 can range from about +/−3 inches of water to about +/−60 inches of water. In another configuration, the deviation from ambient pressure or atmospheric pressure causing the vacuum or partial vacuum within reservoir 206 can range from about +/−1 inch of water to about +/−30 inches of water. In still another configuration, the deviation from ambient pressure or atmospheric pressure causing the vacuum or partial vacuum within reservoir 206 can range from about +/−6 inches of water to about +/−8 inches of water.

Stated another way, the deviation from ambient pressure or atmospheric pressure causing the vacuum or partial vacuum within reservoir 206 can range from about +/−5.60 torr to about +/−111.99 torr. In another configuration, the deviation from ambient pressure or atmospheric pressure causing the vacuum or partial vacuum within reservoir 206 can range from about +/−1.87 torr to about +/−55.99 torr. In still another configuration, the deviation from ambient pressure or atmospheric pressure causing the vacuum or partial vacuum within reservoir 206 can range from about +/−11.21 torr to about +/−14.97 torr.

Stated in still another way, the deviation from ambient pressure or atmospheric pressure causing the vacuum or partial vacuum within reservoir 206 can range from about +/−0.11 PSI to about +/−2.17 PSI. In another configuration, the deviation from ambient pressure or atmospheric pressure causing the vacuum or partial vacuum within reservoir 206 can range from about +/−0.04 PSI to about +/−1.08 PSI. In still another configuration, the deviation from ambient pressure or atmospheric pressure causing the vacuum or partial vacuum within reservoir 206 can range from about +/−0.22 PSI to about +/−0.29 PSI.

By creating a vacuum or partial vacuum within reservoir 206, vacuum pump 202 and/or accumulator 204 reduce the pressure of ink at the nozzles, such pressure being associated with the height difference between the vertical height of the nozzles and the vertical height of the level of ink within reservoir 206. Effectively, a pressure differential is created between reservoir 206 and the pressure at the nozzles, the pressure at the nozzles, in one embodiment being substantially the same as ambient or atmospheric pressure. Illustratively, the difference in pressure between reservoir 206 and ambient or atmospheric pressure is small enough that the adhesion properties and surface tension of the ink maintains meniscus as ambient air attempts to move through the nozzles. The pressure difference can be varied to control the pressure of ink at the nozzles.

Through controlling the pressure of ink at the nozzles, the potential for excessive or insufficient delivery of ink from the nozzles is reduced. Additionally, by controlling the pressure at the nozzles, the curvature of meniscus is controlled; thereby changing the volume of ink delivered from each the nozzle during a printing process. Further, the system can accommodate inks having differing properties and characteristics, such as but not limited to, adhesion characteristics, attraction characteristics, surface tension, temperature dependent properties, or other properties or characteristics of the ink or fluid. For instance, the system can be used to perform a printing process using a first ink in a first reservoir and subsequently used to print using a second ink in a second reservoir. The system can operate with a particular level of a vacuum or partial vacuum and associated ink levels for the first ink and subsequently operate at another level of a vacuum or partial vacuum based upon the ink level and the characteristics and properties of the second ink. Through changing the level of the vacuum or partial vacuum generated by the pump, alone or in combination with the accumulator, the same system can operate using multiple different inks in an efficient manner. With only one variable being changed, the time and money associated with testing of new ink or inks not previously tested with a particular system or printing device are reduced.

This is an advance over existing systems because large sums of money and time must currently be spent in testing differing inks with differing systems to achieve high quality printer output. When new inks or inks not previously tested with a particular system or printing device are to be used with a particular system or device, the manufacturer of the ink and/or system or device must spend numerous hours and large amounts of money to verify that the system or device can print using the proposed ink. Further, the ink or system/device manufacturer must identify usage parameters specific to the ink and system or device, such parameters taking many hours and large quantities of money to generate. In many cases, the systems and/or devices must also be modified to accommodate the new or proposed ink.

According to another aspect of one embodiment of the invention, through creating a vacuum or partial vacuum within reservoir 206, system 200 also degasses the ink within reservoir 206 before the ink is delivered to print head 20*a*. Since a vacuum or partial vacuum is created in reservoir 206, any dissolved gases within the ink migrate to the upper surface of the ink and are drawn out of the ink. In many circumstances, inks are degassed to remove oxygen and other gases dissolved within the ink. Removing the unwanted gases, limits the potential for gas bubbles to flow with the ink to print heads 20*a*–20*n*. In the event that a gas bubble were to reach print heads 20*a*–20*n*, the bubble could prevent ink from being delivered therefrom, resulting in an inoperable print head. Additionally, removing gas bubbles aids with maintaining a consistent ink pressure. Since gas bubbles within the ink are compressible, the pressure of the ink can vary based upon the particular compressibility characteristics of the gas forming the bubble. Hence, the ink pressure may not be accurately maintained within the desired tolerances and the resultant print quality may be reduced when the ink includes dissolved gases. Therefore, vacuum pump 202, either alone or in combination with accumulator 204, is one structure capable of performing the function of means for degassing a fluid. One skilled in the art in can identify other structures capable of performing this function.

Figure 8:
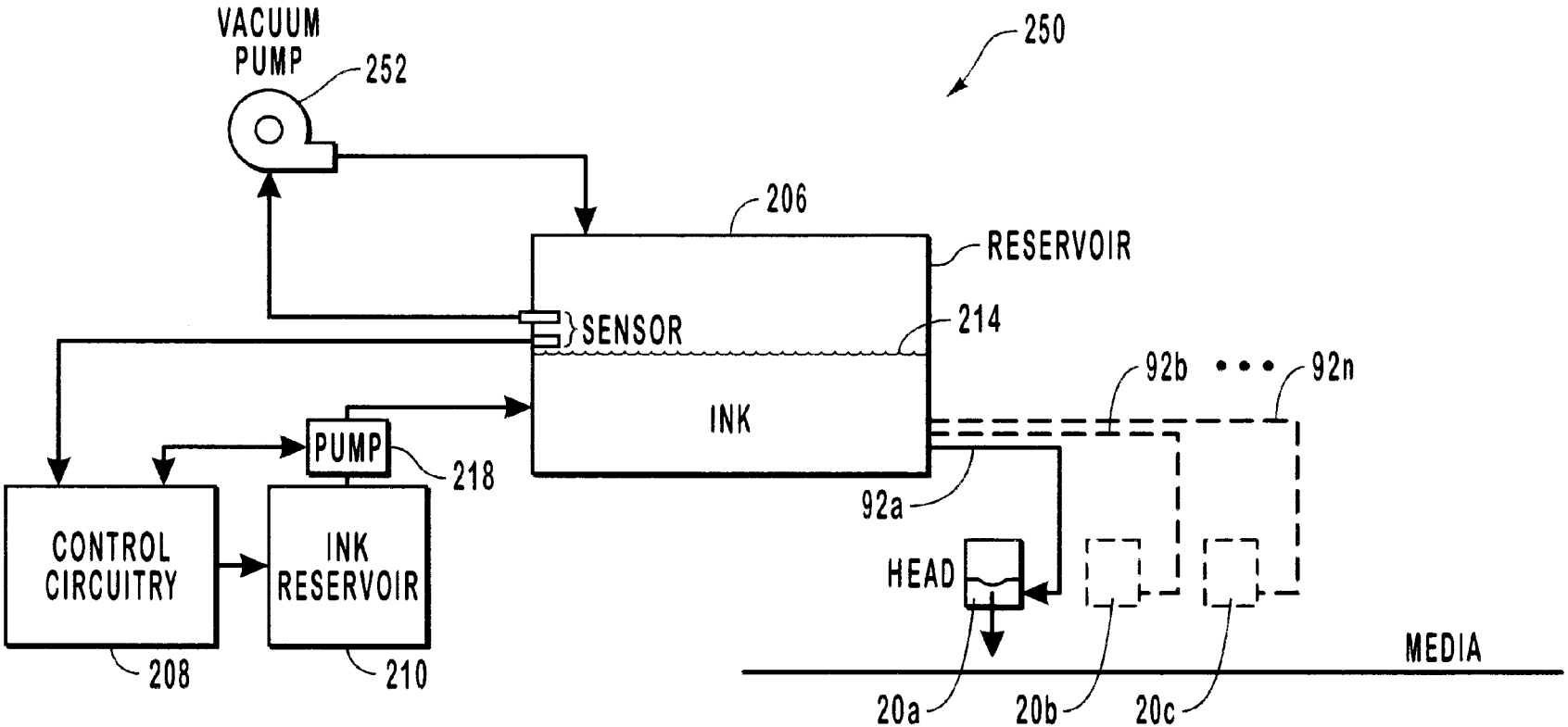
FIG. 8 illustrates a schematic representation of another exemplary printing system of one embodiment of the present invention.

Referring now to FIG. 8, another configuration of one system of the present invention is depicted. The discussion of the features of the other systems described herein is equally applicable to system 250. Consequently, only changes between system 200 and 250 will be discussed herein.

As illustrated, system 250 includes a pump 252 that directly communicates with reservoir 206 and controller 208. In this configuration, pump 252 optionally includes the capabilities of accumulator 204 and/or is capable of making small changes in the level of the vacuum or partial vacuum within reservoir 206. As with system 200, pump 252 can operate under the command of controller 208. Consequently, pump 252 is one structure capable of performing the function of means for creating a vacuum or partial vacuum within a reservoir and means for degassing a fluid.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A printing system comprising:

reservoir comprising an interior space within which is stored a fluid;

a print head communicating with said interior volume, said print head comprising a nozzle adapted to expel a volume of said fluid during a printing process; and a pump communicating with said interior volume, said pump adapted to create a vacuum within said interior space and change a level of said vacuum, wherein said level of said vacuum controls said volume of said fluid delivered from said nozzle.

2. A printing system as recited in claim 1, further comprising an accumulator communicating with said pump and said reservoir.

3. A printing system as recited in claim 1, further comprising a controller, said controller being adapted to control the operation of said pump to create said vacuum.

4. A printing system as recited in claim 1, further comprising a tube coupled to said reservoir and said print head, said tube being filled with said fluid and delivering said fluid from said reservoir to said print head under the control of said vacuum.

5. A printing system as recited in claim 1, further comprising a sensor communicating with said interior space of said reservoir, said sensor being adapted to identify a level of said fluid within said interior space.

6. A printing system as recited in claim 1, further comprising a remote main fluid reservoir communicating with said reservoir, fluid from said remote main fluid reservoir being delivered to said reservoir under the control of a controller.

7. A printing system as recited in claim 6, a sensor communicating with said interior space of said reservoir, said controller delivering said fluid to said reservoir in response to one or more signals from said sensor.

8. A printing system comprising:

means for storing a fluid;

means, communicating with said means for storing, for delivering a volume of said fluid to printable media during a printing process; and means, communicating with said means for storing, for varying a level of a vacuum within said means for storing, wherein said level of said vacuum controls said volume of said fluid delivered from said means for delivering.

9. A printing system as recited in claim 8, wherein said means for storing comprises one or more reservoirs.

10. A printing system as recited in claim 8, wherein said means for delivering further comprises:

means for depositing said volume of said fluid to the printable media; and means for providing a fluid pathway between said means for storing and said means for depositing.

11. A printing system as recited in claim 10, wherein said means for depositing said volume of said fluid comprises one or more print heads.

12. A printing system as recited in claim 10, wherein said means for providing a fluid pathway comprises one or more lumens in fluid communication with said means for storing.

13. A printing system as recited in claim 8, further comprising means for creating said vacuum in said means for storing.

14. A printing system as recited in claim 13, wherein said means for creating said vacuum comprises at least one of a vacuum pump, an accumulator, and a controller.

15. A printing system as recited in claim 13, further comprising means for increasing the precision of said means for creating said vacuum.

16. A printing system as recited in claim 15, where said means for increasing the precision of said means for creating said vacuum comprises an accumulator disposed between said means for creating said vacuum and said means for storing.

17. A printing system as recited in claim 8, further comprising means for identifying a level of said fluid within said means for storing.

18. A printing system as recited in claim 17, wherein said means for identifying comprises at least one of a fluid sensor and a fluid sensor device.

19. A printing system as recited in claim 8, further comprising means for identifying a level of said vacuum.

20. A printing system as recited in claim 19, wherein said means for identifying comprises a vacuum sensor.

21. A printing system as recited in claim 8, further comprising means, communicating with said means for storing, for remotely storing said fluid, wherein said means for remotely storing said fluid delivers said fluid to said means for storing.

22. A printing system as recited in claim 21, wherein said means for remotely storing said fluid comprises at least one of a remote main ink reservoir and an ink pump.

23. A printing system as recited in claim 8, further comprising means for varying said level of said fluid within said means for storing.

24. A printing system as recited in claim 23, wherein said means for varying said level comprises means for identifying said level of said vacuum;

means for determining if the identified level of said vacuum is within a tolerance level; and means for varying at least one of said level of said fluid within said means for storing and said vacuum level within said means for storing until said level of said vacuum is within said tolerance level.

25. A printing system as recited in claim 23, wherein said means for varying said level comprises means for identifying said level of said fluid within said means for storing;

means for determining if the identified level of said fluid is within a tolerance level; and means for varying at least one of said level of said fluid within said means for storing and said vacuum level within said means for storing until said level of said vacuum is within said tolerance level.

26. A printing system as recited in claim 8, further comprising means for degassing said fluid.

27. A printing system as recited in claim 26, wherein said means for degassing said fluid comprises means for creating said vacuum within said means for storing, wherein said vacuum causes any gases dissolved within said fluid to migrate to and escape from a surface of said fluid.

28. A printing system comprising:

an ink reservoir comprising an interior space adapted to receive ink;

a tube fluidly communicating with said ink, said tube comprising a lumen filled with a portion of said ink;

a print head in fluid communication with said lumen of said tube, said print head comprising at least one nozzle communicating with said ink; and a pump in fluid communication with said ink, said pump adapted to create a vacuum within said interior space and change a level of said vacuum to control a pressure of said ink at said at least one nozzle, wherein said level of said vacuum controls a volume of said ink delivered from said at least one nozzle.

29. A printing system as recited in claim 28, further comprising an accumulator communicating with said pump and said ink reservoir.

30. A printing system as recited in claim 29, wherein said accumulator aids said pump to incrementally change said level of said vacuum within said ink reservoir.

31. A printing system as recited in claim 29, further comprising a controller, said controller being adapted to control the operation of said pump to create and change said vacuum.

32. A printing system as recited in claim 31, further comprising a sensor communicating with said interior space of said ink reservoir, said sensor being adapted to identify a level of said fluid within said interior space.

33. A printing system as recited in claim 31, further comprising a sensor communicating with said interior space of said ink reservoir and said controller, said sensor being adapted to generate a signal indicating a level of said ink within said interior space and deliver said signal to said controller.

34. A printing system as recited in claim 28, wherein a meniscus of said ink is formed at said at least one nozzle.

35. A printing system as recited in claim 34, wherein a curvature of said meniscus is changed as said level of said vacuum is changed.

36. A printing system as recited in claim 28, wherein said pump is further adapted to degas said ink, whereby creating said vacuum in said reservoir degasses said ink within said ink reservoir.

37. A printing system as recited in claim 28, further comprising a main ink reservoir communicating with said ink reservoir.

38. A printing system adapted for use with a first ink and a second ink that have differing properties, the system comprising:

a reservoir support adapted to receive either a first ink reservoir adapted to store the first ink or a second ink reservoir adapted to store the second ink at one time;

a print head communicating with either said first ink reservoir or said second ink reservoir at one time, said print head comprising at least one nozzle adapted to deliver a volume of either the first ink or the second ink at one time to a printable media; and a pump in communication with either said first ink reservoir or said second ink reservoir at one time, said pump being adapted to create a first vacuum level within said first ink reservoir and a second vacuum level within said second ink reservoir, wherein upon substituting said second ink reservoir for said first ink reservoir, said pump changes said vacuum level from said first vacuum level to said second vacuum level.

39. A printing system as recited in claim 38, further comprising an accumulator communicating with said pump.

40. A printing system as recited in claim 38, wherein the first ink is delivered from said nozzle at a first pressure and the second ink is delivered from said nozzle at a second pressure different from said first pressure.

41. A printing system as recited in claim 40, wherein said first vacuum level is different from said second vacuum level.

42. A printing system as recited in claim 38, further comprising:

a first sensor within said first ink reservoir, said first sensor being adapted to generate a first signal indicating a level of the first ink in said first ink reservoir; and a second sensor within said second ink reservoir, said second sensor being adapted to generate a second signal indicative of a level of the second ink in said second ink reservoir.

43. A printing system as recited in claim 42, further comprising a controller, said controller being adapted to receive either said first signal or said second signal at one time and deliver a control signal to said pump to change said level of said vacuum based upon the received signal from said first sensor or said second sensor.

44. A printing system as recited in claim 38, wherein said pump is further adapted to degas the first ink and the second ink, whereby creating said vacuum in said first reservoir degasses the first ink within said first ink reservoir and creating said vacuum in said second reservoir degasses the second ink within said second ink reservoir.

45. A printing system as recited in claim 38, wherein a first meniscus of the first ink is formed at said at least one nozzle when said first ink reservoir fluidly communicates with said print head and a second meniscus of the second ink is formed at said at least one nozzle when said second reservoir fluidly communicates with said print head.

46. A printing system as recited in claim 45, wherein a curvature of said first meniscus is created by a first pressure of the first ink, said first pressure being defined by the change in vertical height between said at least one nozzle of said print head and a first level of the first ink in said first ink reservoir and said first vacuum within said first ink reservoir.

47. A printing system as recited in claim 45, wherein a curvature of said second meniscus is created by a second pressure of the second ink, said second pressure being defined by the change in vertical height between said at least one nozzle of said print head and a second level of the second ink in said second ink reservoir and said second vacuum within said second ink reservoir.

48. A printing system comprising:

a reservoir comprising an interior space that is at least partially filled with an ink;

a print head fluidly communicating with said interior space, said print head comprising a nozzle adapted to receive a portion of said ink from said reservoir and expel said portion of said ink during a printing process; and a pump, communicating with said interior space, adapted to degas said ink stored within said reservoir by controlling a vacuum level within said interior space.

49. A printing system as recited in claim 48, further comprising a controller, said controller being adapted to control the operation of said pump to create said vacuum.

50. A printing system as recited in claim 49, further comprising a main ink reservoir communicating with said reservoir.

51. A printing system as recited in claim 50, further comprising an ink pump communicating with said main ink reservoir.

52. A printing system as recited in claim 51, wherein said controller communicates with said ink pump and receives said signal from said sensor, whereby upon said signal indicating said level of said ink is below a tolerance level, said controller activates said ink pump to deliver ink to said ink reservoir.

53. A printing system as recited in claim 48, wherein said pump communicates with an accumulator.

54. A printing system as recited in claim 53, wherein at least one of said pump, said accumulator and said reservoir includes a sensor, said sensor being adapted to generate a signal indicating a vacuum level within said reservoir.

55. A printing system as recited in claim 53, wherein said reservoir comprises a level sensor, said level sensor being adapted to generate a signal indicating an ink level within said reservoir.

56. A method for controlling a level of a vacuum within a reservoir of a printing device to control a volume of an ink to be delivered to the printable media, the method comprising:

defining a first pressure level of an ink at a nozzle of a print head and a first vacuum level to achieve said pressure level;

following delivery of a portion of said ink from the reservoir to said print head, identifying a second pressure level for said ink at said nozzle of said print head; and changing said first vacuum level to a second vacuum level to change said second pressure level to substantially equal said first pressure level, wherein changing said second pressure level to said first pressure level controls a volume of said ink to be delivered to the printable media.

57. A method as recited in claim 56, wherein defining said pressure level and said first vacuum level comprises:

determining a first ink level of said ink;

identifying a fluid pressure level of said ink at said nozzle based upon said first ink level; and defining said first vacuum level in said reservoir to adjust said first pressure level to said pressure level.

58. A method as recited in claim 57, wherein determining said first ink level comprises identifying a first signal from an ink level sensor communicating with said reservoir, said first signal indicating said first ink level.

59. A method as recited in claim 57, wherein identifying said fluid pressure level of said ink comprises defining a difference in vertical height between said nozzle and said first ink level, said difference indicating said fluid pressure level.

60. A method as recited in claim 57, wherein defining said first vacuum level comprises identifying a difference between said fluid pressure level and said pressure level; and determining said vacuum level that adjusts said fluid pressure level to substantially equal said first pressure level.

61. A method as recited in claim 56, wherein identifying a second pressure level for said ink at said nozzle of said print head comprises:

determining a second ink level of said ink; and identifying a second fluid pressure level of said ink at said nozzle based upon said second ink level; and identifying said second pressure level of said ink based upon said second fluid pressure level and said second vacuum level.

62. A method as recited in claim 56, wherein changing said first vacuum level to said second vacuum level comprises:

identifying said second pressure level of said ink at said nozzle of said print head; and controlling a pump in communication with said reservoir to change said first vacuum level to said second vacuum level where said second pressure level substantially equals said first pressure level.

63. A method as recited in claim 62, wherein controlling said pump comprises changing said first vacuum level to said second vacuum level until said second pressure is within at least one tolerance value associated with said first pressure level.

* * * * *

UNITED STATES PATENT AND TRADEMARK OFFICE

CERTIFICATE OF CORRECTION

PATENT NO. : 6,705,711 B1
DATED : March 16, 2004
INVENTOR(S) : David B. Richards It is certified that error appears in the above-identified patent and that said Letters Patent is hereby corrected as shown below:

Title page,
Item [56], References Cited, U.S. PATENT DOCUMENTS,
"4,084,165" reference, change "Perry et al." to -- Skafvenstedt et al. --.

Column 2,
Line 21, change "causes" to -- cause --.

Column 6,
Line 18, before "various" change "includes" to -- include --.
Line 42, before "Apertures" begin a new paragraph.
Line 42, after "Apertures" change "34a–34a" to -- 34a–34n --.
Line 53, change "mechanism" to -- mechanisms --.
Line 54, change "attaching" to -- attach --.
Line 56, after "maintained" remove "in".

Column 7,
Line 25, after "circuitry" change "(not show)" to -- (not shown) --.
Line 36, before "skilled" change "Once" to -- One --.
Line 37, after "other" change "configuration" to -- configurations --.

Column 8,
Line 60, before "can be used" change "sensor" to -- sensors --.

Column 9,
Line 48, after "connectors" change "92a–92d" to -- 96a–96d --.
Line 60, before "print" remove "a".

Column 10,
Line 51, change "includes" to -- included --.

Column 12,
Line 13, after "can" change "ranges" to -- range --.
Line 67, after "one" change "embodiments" to -- embodiment --.

UNITED STATES PATENT AND TRADEMARK OFFICE

CERTIFICATE OF CORRECTION

PATENT NO. : 6,705,711 B1
DATED : March 16, 2004
INVENTOR(S) : David B. Richards It is certified that error appears in the above-identified patent and that said Letters Patent is hereby corrected as shown below:

Column 13,
Line 55, before "the ink level" remove "that".
Line 59, after "reservoir" change "201" to -- 210 --.

Column 14,
Line 7, after "receiving" insert -- a --.

Column 15,
Line 65, before "nozzle" remove "the".

Signed and Sealed this

Sixteenth Day of May, 2006

JON W. DUDAS
*Director of the United States Patent and Trademark Office*